US007100779B2

(12) United States Patent
Berg

(10) Patent No.: US 7,100,779 B2
(45) Date of Patent: Sep. 5, 2006

(54) BOARD FOR PEGBOARD SYSTEM

(75) Inventor: Joel J. Berg, Chicago, IL (US)

(73) Assignee: Cencor Plastics, Inc., Chicago, IL (US)

( * ) Notice: Subject to any disclaimer, the term of this patent is extended or adjusted under 35 U.S.C. 154(b) by 0 days.

(21) Appl. No.: 10/438,410

(22) Filed: May 16, 2003

(65) Prior Publication Data

US 2004/0226901 A1 Nov. 18, 2004

(51) Int. Cl.
*A47F 5/08* (2006.01)

(52) U.S. Cl. ..... 211/87.01; 211/57.1; 211/59.1; 248/220.31

(58) Field of Classification Search ..... 211/87.01, 211/106, 57.1, 59.1; 248/220.31, 220.41, 248/220.43, 220.42; D25/153, 155
See application file for complete search history.

(56) References Cited

U.S. PATENT DOCUMENTS 3,014,597 A * 12/1961 McWherter ..... 211/175
3,322,287 A * 5/1967 Ragir ..... 211/87.01
3,452,959 A * 7/1969 Ishikawa ..... 248/488
3,497,079 A * 2/1970 Kulwiec ..... 211/87.01
3,865,249 A * 2/1975 Herzog ..... 211/163
3,931,894 A * 1/1976 Murphy ..... 211/189
4,461,443 A * 7/1984 Dauman ..... 248/220.41
4,815,612 A * 3/1989 Leo, Sr. ..... 211/189
4,932,538 A * 6/1990 Gambello ..... 211/87.01
4,951,827 A * 8/1990 Moransais ..... 211/59.1
5,927,517 A * 7/1999 Lipman et al. ..... 211/59.1
6,481,584 B1 * 11/2002 Cantley ..... 211/87.01

* cited by examiner

*Primary Examiner*—Bruce A. Lev
(74) *Attorney, Agent, or Firm*—Charles F. Lind

(57) ABSTRACT

This pegboard is injection molded of plastic yielding a unitized flat panel, and rearwardly projecting peripheral flanges and cross webs terminating along a single plane, suited to provide clearance for a cooperating hook between a panel rear face and a flat mounting surface. The pegboard has rows and columns of holes of both nominal ⅛ inch and ¼ inch diameters on one inch centers, to accommodate both conventional nominal size hooks. The respective rows and columns of the different size holes are alternately arranged offset from one another vertically and horizontally, allowing either size hook mounting virtually anywhere on the panel. Locating structures on the rear side of the pegboards provide accurate back to back squared registry positioning of two like pegboards, for cool-down after molding without shape distortion and for stable twin-pack packaging for retail sales.

7 Claims, 1 Drawing Sheet

BOARD FOR PEGBOARD SYSTEM

BACKGROUND OF THE INVENTION

Pegboard systems are commonly used for storing tools or varied items, spaced off a vertical wall of a garage, workshop or the like. A conventional pegboard system is comprised of a flat sheet or panel with many holes arranged in equally spaced crossing rows and columns, and rigid hooks each suited to be easily inserted through one or more hole(s) to be secured to the panel at almost any location. Each hook will have a forward portion shaped to receive and hold the item to be stored, and a shank and upturned rear tab that can be inserted into or through the hole(s) to become interlocked on the panel.

As the rear hook tab protrudes beyond the rear face of the panel, the panel must be supported slightly forward of the wall, conventionally by separate furring stripes located around the perimeter of the panel. This makes fabrication and/or installation of the pegboard panel more difficult, such as merely screwing a flat panel against a wall surface.

The pegboard Systems come in two common sizes: the panels of one system having holes of nominal ⅛ inch diameter to receive hooks of nominal ⅛ inch diameter wire gauge, and the panels of the other system having holes of nominal ¼ inch diameter to receive hooks of nominal ¼ inch diameter wire gauge. Depending on the source of the pegboard systems, the nominal sizes of the hooks, hole diameters and panel thickness will actually vary, where for example a ⅛ inch hook wire gauge might be between 0.12–0.16 inch diameter, the nominal ⅛ inch hole might be up to 0.20 inch diameter, the nominal ¼ inch hook might be between 0.20–0.24 inch diameter, and the nominal ¼ inch hole might be up to 0.30 inch diameter. The panels of each system also might vary, but nominally might be ⅛ inch and ¼ inch thick.

Of interest to this invention, the panel holes of either hook size system are all of the same size, meaning that a separate panel is required for the use of each hook size. Although ⅛ inch hooks can generally be fitted on the ¼ inch panels, excessive free play can result in unstable support of the hook which can be easily dislodged and/or drop its supported item. However, ¼ inch hooks typically cannot be fitted on the ⅛ inch boards.

SUMMARY OF THE INVENTION

This invention relates to and an object of this invention is to provide a pegboard system having a flat panel or sheet and unitized peripheral flanges and cross webs rearwardly projected off of the rear face of the panel, where the rear edges of the flanges and webs are generally disposed along a plane spaced rearwardly of and parallel to the panel rear face so as to allow installation of the panel onto any flat mounting surface without furring strips while yet providing hook tab clearance between the panel rear face and mounting surface.

A more detailed object of the invention is to provide a pegboard panel of molded plastic, where the panel, flanges and cross webs are integrally formed as part of a single unit.

Another invention object of the invention is to provide stable cool-down of the molded pegboard panel by clamping two like panels in squared registry with the rear flange and cross web faces against one another during the cool-down; where the locating structures for establishing the squared two panel registry can further stabilize them for packaging as a twin pack for subsequent retail sales.

A further object of this invention is to provide a pegboard panel having rows and columns of holes of both the nominal ⅛ inch and the ¼ inch diameters, to accommodate on a single board both nominal ⅛ inch and ¼ inch diameter hooks.

A more specific object of the invention is to offset the respective rows and columns of the different size holes from one another, such as by one-half inch to be centered between the conventional hole rows and columns on one inch centers, so that either size hook can be located virtually anywhere on the panel in appropriate hole(s) thereat.

BRIEF DESCRIPTION OF THE DRAWINGS

These and other objects, features or advantages of this invention will be more fully understood and appreciated after consideration of the following description of the invention, which includes the accompanying drawings, wherein.

DETAILED DESCRIPTION OF THE INVENTION

Figure 1:
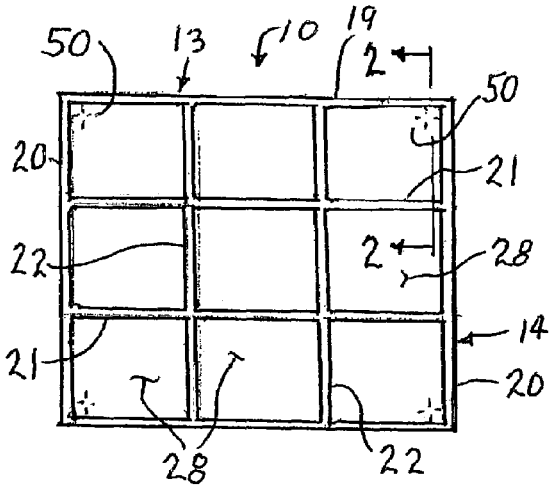
FIG. 1 is an elevational view of the rear side of an improved pegboard disclosed herein, without showing holes due to their small sizes but merely instead identifying the areas where they would be located on the planar pegboard panel.
Figure 2:
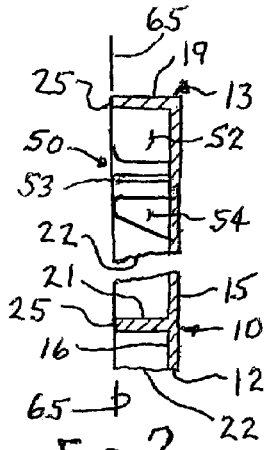
FIG. 2 is an enlarged sectional view as generally seen from line 2—2 in FIG. 1.
Figure 3:
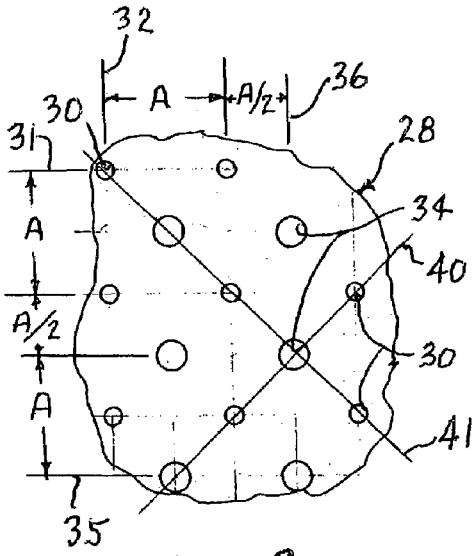
FIG. 3 is an enlarged elevational view showing a hole pattern preferred for use in the pegboard of FIG. 1.

The pegboard 10 illustrated is comprised as a rectangular planar panel 12 having peripheral edges 13, 14, and having front and rear faces 15, 16. Peripheral flanges 19, 20 are projected rearwardly off of the panel 12 at the edges 13, 14, and intermediate cross webs 21, 22 are projected rearwardly off of the rear panel face 16 disposed parallel and normal to and extended to the different respective peripheral flanges. The peripheral flanges 19, 20 and intermediate cross webs 21, 22 have rear faces 25 that lie generally along a single plane spaced rearwardly from the rear panel face 16 by a distance sufficient to allow hook insertion onto, removal from, or secured mounting on the panel 12 as needed.

The pegboard panel 12, in the regions 28 between the rearwardly projected flanges 19,20 and crossing intermediate webs 21, 22, has small holes 30 arranged in horizontal rows 31 and vertical columns 32, and has large holes 34 arranged in horizontal rows 35 and vertical columns 36. This hole arrangement is suited to allow the pegboard panel 12 to accept both small and large item carrying hooks 38 and 39. The holes 30, 34 might respectively have to the nominal ⅛ or ¼ inch diameters.

More specifically with respect to the subject invention, the respective rows and columns of the different size holes 30, 34 are alternately arranged and are offset from one another both horizontally and vertically by approximately the "A/2" distance. This further provides that the different size holes are alternately arranged and centered along diagonally angled patterns 40, 41 disposed on approximately 45 degree angles from the horizontal rows 31, 35 and vertical columns 32, 36.

Figure 4:
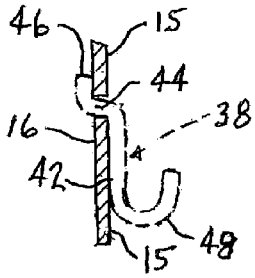
FIG. 4 is a centered sectional view through a small hole in FIG. 3, illustrating in phantom a small hook secured thereat.

Every hook 38, 39 basically has a front portion 42, 43 disposed to lie against the front panel face 15, a shank 44, 45 angled normally and rearwardly off of the front portion 42, 43 and disposed to extend through the panel thickness, and a rear tab 46 47 upturned off of the shank and disposed to lie against the rear panel face 16. The pegboard thickness at the hole will be less than the length of the shank 44, 45. Thus, the tab 46, 47 and shank 44, 45 can be inserted into or through the hole(s) 30, 34 upon the rotation of the hook first counterclockwise (in FIGS. 4, 5) and then approximately one-quarter turn clockwise so that it interlocks onto the panel as illustrated. The hook tab 46, 47 protrudes beyond the rear face 16 of the panel 12 during this hook manipulation, and butts against and protrudes away from the rear panel face when the hook is supported on the panel. The hook also has a holding portion 48, 49 projecting transversely and forwardly off of the front portion 42, 43 and shaped in a manner suited to hold the item desired, shown here merely as being curved forwardly and upwardly to its end spaced from both the hook front portion and panel front face.

Part of this invention is forming the pegboard 10 of plastic, by injection molding. This results the pegboard panel and all flanges and webs unitized, and forming all holes also in this single molding process. However, after the pegboard is ejected from the molding apparatus, it is hot and somewhat flexible and must be held squared up with the front panel faces flat and planar until cooled sufficiently to be stable. This invention provides a stabilized cool-down process, and requiring that all of the pegboards are the same with the flanges and intermediate webs symmetrically located relative to the pegboard center. Thus, when two pegboard are in back to back contacting position, the rear faces of the flanges and webs contact and create a squared registry condition with the front panel faces 15 flat and planar.

Figure 6:
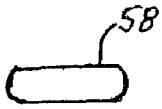
FIG. 6 is an elevational view of a locating pin used between two oppositely facing or back to back like pegboards.
Figure 7:
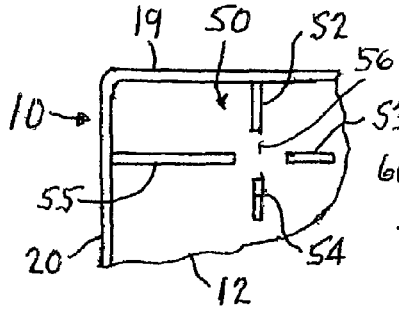
FIG. 7 is an enlarged elevational view of the left corner of FIG. 1, showing details of the pin holding structure thereat.
Figure 8:
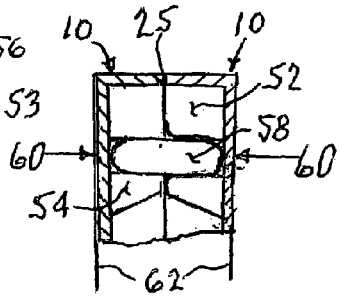
FIG. 8 is a sectional view illustrating two back to back like pegboards is squared registry pegboards as held by the locating pins suited for post fabrication cool-down thereof and/or for retail sales packaging as a twin pack.

The structures 50 for easily locating this stabilized cool-down position includes webs 52, 53, 54, 55, radiating from an open central space 56, that are formed off the rear panel face near each corner of the panel. A pin 58 (FIG. 6) is provided suited to be fitted snuggly but removably into each space 56, projecting then normally away from the front face 15. A hot first post fabrication pegboard can be laid front face down on a flat surface (not shown) and one end of the four locating pins 58 can be inserted into the spaces 56. A second hot post fabrication pegboard can then be positioned with its locating spaces 56 over and onto the yet exposed other ends of the pins 58. The two squared up and in registry panels can then be clamped together at the corners, as illustrated by arrows 60 in FIG. 8, until sufficient cool-down has occurred, such as to room temperature.

After cool-down, the paired panels can be unclamped but they will yet be held in squared registry by the locating structures 50 and pins 58, with the front faces 15 exposed outwardly. At this point, printed flat sheet product promotional material (not shown) can be laid against either front face 15 and the entire assembly can be wrapped in transparent cellophane or the like 62 to form a twin pack package suited for subsequent retail sales. When the package ultimately is opened, locating pins 58 can be discarded, and the two pegboards can be mounted where needed for end use.

Each pegboard 10 can be secured to a vertical wall or like surface 65 by passing mounting screws (not shown) through any of the panel holes, at appropriate locations (to hit wall studs or the like) and in sufficient numbers to support the carried weight of the pegboard and loaded hooks. When so mounted, the rear faces 25 of the flanges and webs butt against mounting surface 65 to space and support the rear panel face 16 therefrom for needed hook clearances, and further to reinforce and provide solid panel support at the crossing webs 21, 22 (which might be at 6–10 inch spacings) to add to the maximum carried loads.

Figure 5:
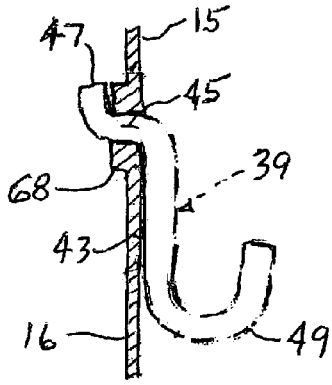
FIG. 5 is a centered sectional view of an alternate embodiment through a large hole in FIG. 3, illustrating in phantom a large hook secured thereat.

Although not necessary, the panel 12 adjacent the larger holes 34 optionally might be reinforced by adding to the panel thickness around these holes, such as at rearwardly protruding bosses 68 (see FIG. 5).

While specific structures have been illustrated, minor changes could be made without departing from the spirit of the inventive teaching. Accordingly, the invention is to determined by the scope of the following claims.

What is claimed is:

1. For a pegboard system consisting of a pegboard with a planar panel having holes arranged in horizontal rows and vertical columns through the panel, and hooks suited to be secured onto the panel at the holes, an improved pegboard comprising the pegboard panel being formed of plastic by injection molding and having integrally formed therewith rearwardly projected peripheral edge flanges and intermediate cross webs extended to and between the peripheral flanges;

the flanges and webs having rear faces lying along a single plane rearwardly spaced from a rear panel face so that the panel can be secured relative to a vertical surface with the rear faces of the flanges and webs against said surface so as to provide clearance space between the rear panel face and said surface for allowing hook insertion and removal relative to the panel;

means formed off the rear panel face at spaced locations, operable to hold in squared back to back registry two like panels with the flange and web rear faces engaged, suited when clamped together to provide stabilized post molding cool-down and further to provide stabilized twin-pack packaging of such pegboards.

2. A pegboard improvement according to claim 1, further comprising the holes selectively including both ⅛ or ¼ inch nominal size diameters suited to receive hooks of nominal ⅛ and ¼ inch nominal gauges.

3. A pegboard improvement according to claim 2, further comprising the different size holes being arranged in each's respective rows and columns, and the rows and columns of the different size holes being offset both horizontally and vertically from one another.

4. A pegboard improvement according to claim 3, further comprising the panel thickness between the front and rear faces being greater at the larger holes than at the smaller holes.

5. For a pegboard system consisting of a pegboard with a planar panel having front and rear faces, holes arranged in horizontal rows and vertical columns through the panel, and hooks suited to be secured onto the panel at the holes, an improved pegboard comprising rearwardly projected peripheral flanges unitized with the panel off the rear panel face;

rearwardly projected intermediate cross webs unitized with the panel off the rear panel face and extended to the peripheral flanges;

the peripheral flanges and intermediate cross webs having rear faces lying along a single plane rearwardly spaced from the rear panel face;

means formed off the rear panel face near the panel corners, operable to hold in squared registry two like oppositely faced pegboards having the rear flange and web faces engaged, for stabilizing twin-pack packaging of two such pegboards for retail sales, and means to secure either unpacked pegboard with the rear face of the flanges and webs against a vertical mounting surface, whereby the rear panel face is spaced from said mounting surface to allow hook insertion and removal relative to the panel.

6. A pegboard improvement according to claim 5, further comprising said means formed off the rear panel face being in the form of webs integrally formed off each rear panel face and radiating from a central space, and a member suited to be fitted into the spaces of the two pegboards and be releasibly held by said webs for holding the squared registry.

7. A pegboard according to claim 5, further comprising the pegboard being formed of plastic by injection molding requiring post fabrication cooldown after ejection from the molding apparatus, and the two pegboards being clamped together in back to back squared registry during such cool-down and further being held in this squared registry position even after being unclamped for stabilizing twin-pack packaging of such pegboards.

* * * * *